US007942766B2

(12) United States Patent
van Rooij et al.

(10) Patent No.: US 7,942,766 B2
(45) Date of Patent: May 17, 2011

(54) APPARATUS AND METHOD FOR STRETCHING THE LINKS OF A TRANSMISSION CHAIN WHILE SURPASSING THE LIMIT OF ELASTICITY THEREOF

(75) Inventors: Jacobus Hubertus Maria van Rooij, Nuenen (NL); Johannes Henricus Nelissen, Helmond (NL)

(73) Assignee: Gear Chain Industrial B.V. (NL)

( * ) Notice: Subject to any disclaimer, the term of this patent is extended or adjusted under 35 U.S.C. 154(b) by 1403 days.

(21) Appl. No.: 11/434,361

(22) Filed: May 12, 2006

(65) Prior Publication Data

US 2006/0254248 A1 Nov. 16, 2006

(30) Foreign Application Priority Data

May 13, 2005 (NL) ..... 1029042

(51) Int. Cl.

| | |
|---|---|
| ***F16H 59/00*** | (2006.01) |
| ***F16H 61/00*** | (2006.01) |
| ***F16H 63/00*** | (2006.01) |
| ***F16H 9/12*** | (2006.01) |
| ***F16H 55/56*** | (2006.01) |
| ***F16G 13/04*** | (2006.01) |
| ***B21L 11/00*** | (2006.01) |
| ***B21L 9/00*** | (2006.01) |

(52) U.S. Cl. ..... 474/8; 474/21; 474/25; 474/37; 474/215; 59/1; 59/8

(58) Field of Classification Search ..... 474/21, 474/215, 8, 37, 39, 41, 86, 87, 137; 59/1, 59/8

See application file for complete search history.

(56) References Cited

U.S. PATENT DOCUMENTS

| | | | | |
|---|---|---|---|---|
| 1,849,684 | A * | 3/1932 | Morse | 474/216 |
| 1,966,831 | A * | 7/1934 | Torrence et al. | 474/40 |
| 2,856,752 | A * | 10/1958 | Bahr | 59/2 |
| 3,046,599 | A * | 7/1962 | Nicholas et al. | 26/73 |
| 3,049,933 | A * | 8/1962 | Besel | 474/8 |
| 3,491,402 | A * | 1/1970 | Koyama et al. | 26/73 |
| 3,752,457 | A * | 8/1973 | Parmeggiani et al. | 264/210.2 |
| 3,755,862 | A * | 9/1973 | Molz | 26/73 |
| 3,884,748 | A * | 5/1975 | Andersen et al. | 156/494 |

(Continued)

FOREIGN PATENT DOCUMENTS

EP 0 741 255 B2 5/2000

(Continued)

OTHER PUBLICATIONS

European Search Report NL 1029042 dated Dec. 22, 2005.

*Primary Examiner* — Michael R Mansen
*Assistant Examiner* — Henry Liu
(74) *Attorney, Agent, or Firm* — Ostrolenk Faber LLP

(57) ABSTRACT

To obtain a compact structure and to increase at the same time the structural stiffness of an apparatus for plastically deforming and strengthening the links, which are intercoupled by rocker pins, of a complete endless transmission chain, said apparatus comprises a first and a second pair respectively of conical supporting surfaces for the ends which protrude outside said links of the rocker pins of a transmission chain, mounted thereon, said surfaces having a controllable mutual distance, the invention propose to add a third similar pair of supporting surfaces, provided for cooperation with the first and second shaft. This measure also speeds up the treatment of the transmission chain.

12 Claims, 7 Drawing Sheets

U.S. PATENT DOCUMENTS

| | | | | | |
|---|---|---|---|---|---|
| 3,916,491 | A | * | 11/1975 | Kampf | 26/72 |
| 3,932,919 | A | * | 1/1976 | Hutzenlaub | 26/73 |
| 3,955,251 | A | * | 5/1976 | Hogendyk | 26/80 |
| 4,140,827 | A | * | 2/1979 | Willwerth et al. | 428/151 |
| 4,141,679 | A | * | 2/1979 | Asano et al. | 425/445 |
| 4,201,367 | A | * | 5/1980 | Konen, Sr. | 254/231 |
| 4,233,012 | A | * | 11/1980 | Willwerth et al. | 425/162 |
| 4,413,981 | A | * | 11/1983 | White et al. | 474/94 |
| 4,435,883 | A | * | 3/1984 | Muszynski | 26/71 |
| 4,439,170 | A | * | 3/1984 | Steuer | 474/28 |
| 4,722,719 | A | * | 2/1988 | Klopfenstein | 474/28 |
| 4,807,336 | A | * | 2/1989 | Yoshimura et al. | 26/73 |
| 4,911,682 | A | * | 3/1990 | Ivey et al. | 474/245 |
| 4,912,820 | A | * | 4/1990 | Bregier | 26/71 |
| 5,205,543 | A | * | 4/1993 | Thiede | 254/231 |
| 5,374,221 | A | * | 12/1994 | Casada | 474/29 |
| 5,405,158 | A | * | 4/1995 | Wilding et al. | 280/261 |
| 5,728,021 | A | * | 3/1998 | van Rooij et al. | 474/229 |
| 6,294,029 | B1 | * | 9/2001 | Sakate et al. | 148/211 |
| 6,676,552 | B2 | * | 1/2004 | Scheufele et al. | 474/215 |
| 6,782,818 | B2 | * | 8/2004 | Glockner et al. | 101/228 |
| 6,811,507 | B2 | * | 11/2004 | Baumann et al. | 474/215 |
| 6,824,484 | B2 | * | 11/2004 | Greiter | 474/201 |
| 7,153,123 | B2 | * | 12/2006 | Jackson et al. | 425/325 |
| 7,217,209 | B2 | * | 5/2007 | Saito et al. | 474/242 |
| 7,316,558 | B2 | * | 1/2008 | Merrill et al. | 425/325 |
| 7,320,656 | B2 | * | 1/2008 | Linnenbrugger et al. | 474/219 |
| 2002/0068654 | A1 | * | 6/2002 | Baumann et al. | 474/215 |
| 2002/0091027 | A1 | * | 7/2002 | Scheufele et al. | 474/229 |
| 2003/0036450 | A1 | * | 2/2003 | Linnenbrugger et al. | 474/201 |
| 2003/0186767 | A1 | * | 10/2003 | Greiter | 474/215 |
| 2006/0254248 | A1 | * | 11/2006 | van Rooij et al. | 59/6 |

FOREIGN PATENT DOCUMENTS

| | | |
|---|---|---|
| NL | 1 018 594 C2 | 12/2001 |

* cited by examiner

APPARATUS AND METHOD FOR STRETCHING THE LINKS OF A TRANSMISSION CHAIN WHILE SURPASSING THE LIMIT OF ELASTICITY THEREOF

CROSS-REFERENCE TO RELATED APPLICATION

This application claims the benefit of the filing date of Netherlands Patent Application No. 1029042 filed 13, May 2005, the disclosure of which is hereby incorporated by reference.

BACKGROUND OF THE INVENTION

The invention relates to an apparatus for stretching the links, which are intercoupled by rocker pins, of an endless transmission chain, while surpassing the limit of elasticity thereof, said apparatus comprising a first pair and a second pair of conical supporting surfaces for the ends of the rocker pins, resting thereon, while protruding outside the links of the transmission chain which is arranged there around, said surfaces being carried by rotatingly supported shafts with a controlled mutual distance.

DESCRIPTION OF THE PRIOR ART

Increasing the strength of the links of a transmission chain by stretching the links, while surpassing the limit of elasticity thereof, in a complete endless transmission chain, is already described in 1966 in the article by Dr. Otto Dittrich: "Ein stufenloses Hochleistungsgetriebe mit Stahlriemen", published in VDI Zeitschrift 1966 Nr. 6-February, page 230, line 1 and following.

This treatment, which is thus commonly known, is again described in the U.S. Pat. No. 6,824,484. This publication also describes an apparatus which can be used to this end and which comprises two sets of pulley sheaves positioned at a distance from each other and being part of a common continuously variable transmission. Starting in column 16, line 59 and following, this document states that the respective shafts of these two sets of pulley sheaves can be moved away from each other to generate in this way a stretching force in a complete transmission chain which is placed around these pulley sheaves. When one pair of pulley surfaces runs with its smallest effective diameter the other pair runs with its largest effective diameter.

It is observed that NL 1 018 594, too, describes such an apparatus—vide page 8 line 18-page 9 line 13 and FIG. 5 thereof.

Furthermore the tensioning of an endless chain of a continuously variable transmission by means of a spring-biased tensioning roller such that there are, in fact, three surfaces over which this chain moves is known in itself from U.S. Pat. No. 1,966,831. However, there is here no stretching of the links of the transmission chain at all, and certainly not the surpassing the limit of elasticity of any part of these links.

SUMMARY OF THE INVENTION

The invention aims to provide an improved apparatus of the kind referred to above. According to the invention this apparatus comprises a third, similar pair carried by a third rotating shaft, cooperating with the first and second pair of surfaces in supporting a chain to be stretched, all three pairs of supporting surfaces having such a running radius and being positioned with respect to each other in such a way that said chain covers an arc over each of said supporting surfaces sufficient to ensure that the links of the chain experience, during their travel over said arc, an ensured and sufficient stretching loading of these areas thereof which undergo the heaviest loading during the actual operation of said chain.

The invention thus not only proposes that there are three pairs of supporting surfaces but also that it is ensured that during the stretching of a chain these areas of the links which are in practice and during actual operation most heavily stressed are, in fact, stretched and thus strengthened sufficiently. By increasing the number of times these parts are during one complete run of such a chain loaded beyond the limit of elasticity thereof the treatment of a complete chain is much more effective and can be completed in less time.

The apparatus as proposed by the invention can be constructed much more compact and thus much stiffer than the known apparatus so that one obtains results which are much better reproducible; the respective shafts are subjected to much lower forces and tilting moments as is the case in the known device.

The proposed apparatus can not only be used to stretch a transmission chain but also to obtain a chain with a very accurately defined, calibrated, final length and in this way the inevitable production tolerances of the components of the chain can be compensated. It is thus possible to treat a chain in a very well defined stretching operation while on the other hand one also has the possibility to measure directly at the end of the stretching treatment the resulting permanent elongation of the chain.

A preferred embodiment is such that the three respective rollers have supporting surfaces with mutually different effective diameters with a first value, corresponding with the minimum running diameter encountered in a continuously variable transmission (CVT) in which the said chain is to be used, a second value corresponding with the maximum running diameter to be encountered in said CVT and an intermediate value.

According to an aspect of the invention which is particularly directed to the stretching and thus strenghtening of a chain such as known from EP 741 255 B2 and the corresponding U.S. Pat. No. 5,728,021 this intermediate value is chosen such that it corresponds to that particular running diameter of a chain in which the interpieces, which co-operate with the rocker pins but which do not contact the conical surfaces with their ends, are loaded at their middle surface parts which rest against the narrow edges of the respective links. The favourable strenghtening of these interpieces, resulting from this stretching, also makes it possible to reduce their thickness and thus to reduce the pitch of the chain.

This effect could, of course, also be obtained by using a CVT with its complicated control system—as proposed in U.S. Pat. No. 6,824,484—and running it repeatedly through several cycli of transmission ratios but then this entire procedure would be much more timeconsuming and costly and thus unsuited for incorporation in industrial mass production.

The invention also provides a method of stretching the links, which are intercoupled by rocker pins, of an endless transmission chain, while surpassing the limit of elasticity thereof, using a first pair and a second pair of conical supporting surfaces for the ends of the rocker pins, resting thereon, while protruding outside the links of the transmission chain which is arranged there around, said surfaces being carried by rotatingly supported shafts with a controlled mutual distance, and loading the links beyond the limit of elasticity, in which a third, similar pair carried by a third rotating shaft, is used, said pair cooperating with the first and second pair of surfaces in supporting a chain to be stretched, all three pairs of supporting surfaces having such a running radius and being positioned with respect to each other in such a way that said chain covers an arc over each of said supporting surfaces sufficient to ensure that the links of the chain experience, during their travel over said arc, an ensured and sufficient stretching loading of these areas thereof which undergo the heaviest loading during the actual operation of said chain. In a preferred way of carrying out this method one measures, prior to the stretching operation, the initial, first, length of a chain mounted thereon and then stretches this chain until it has obtained a predetermined second length. In this way one obtains a chain with a very accurately defined final length.

Thus the three respective shafts can each have a separate and well-defined function: the first shaft drives, the second shaft brings about an axial displacement and the third shaft increases the distance with respect to the first and second shaft, such as necessary to stretch the chain. This second shaft can also be coupled to a device which exerts an adjustable braking torque thereon.

DESCRIPTION OF THE DRAWINGS

FIG. 4 shows a cross-section on an enlarged scale of the part which is in FIG. 3 enclosed by the circle 4*b;*

FIG. 4*b* shows in cross-section and schematically a pair of supporting surfaces with a free space there between;

DESCRIPTION OF A PREFERRED EMBODIMENT

Figure 1:
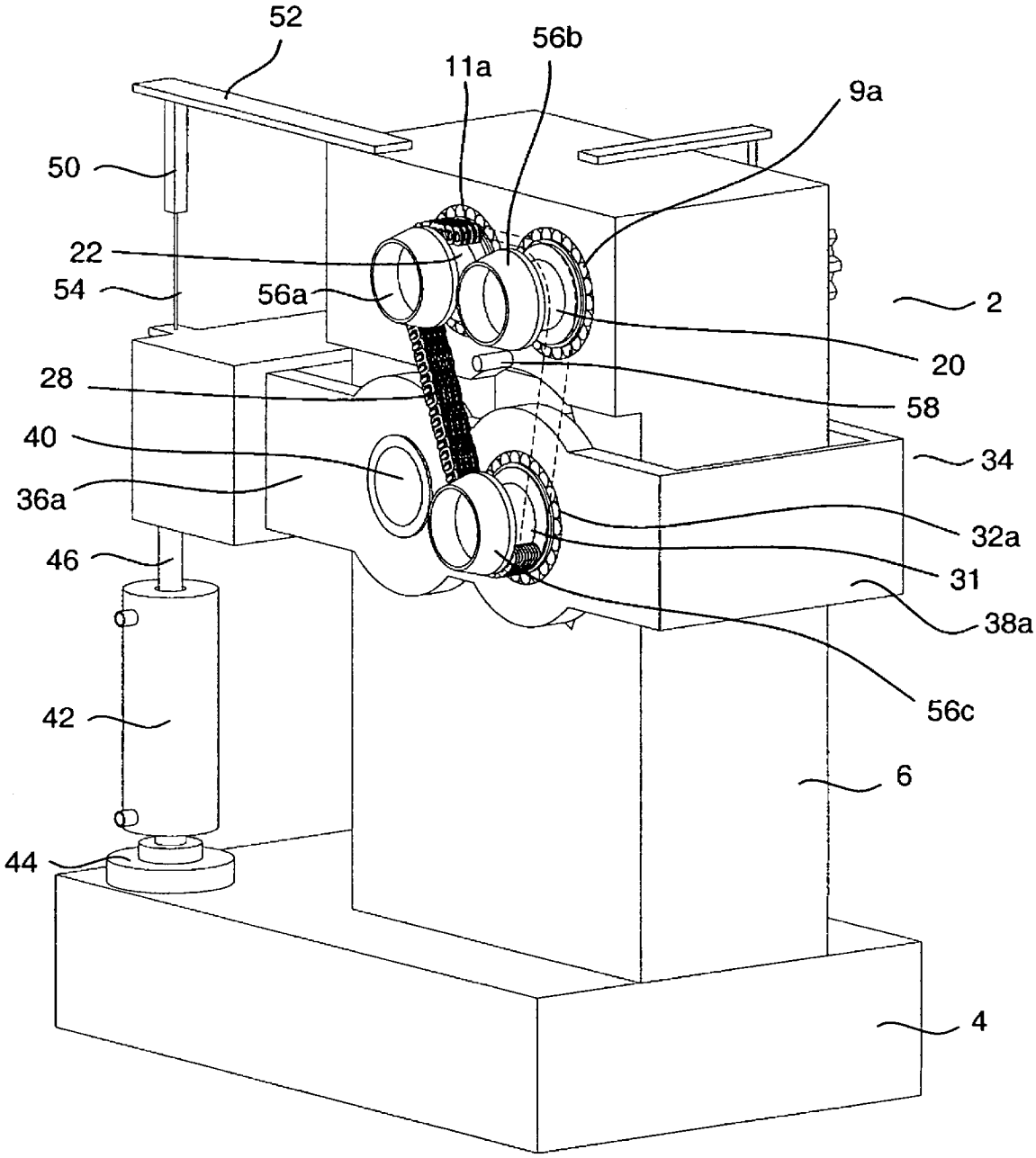
FIG. 1 shows a perspective front view of an embodiment of an apparatus according to the invention.
Figure 2:
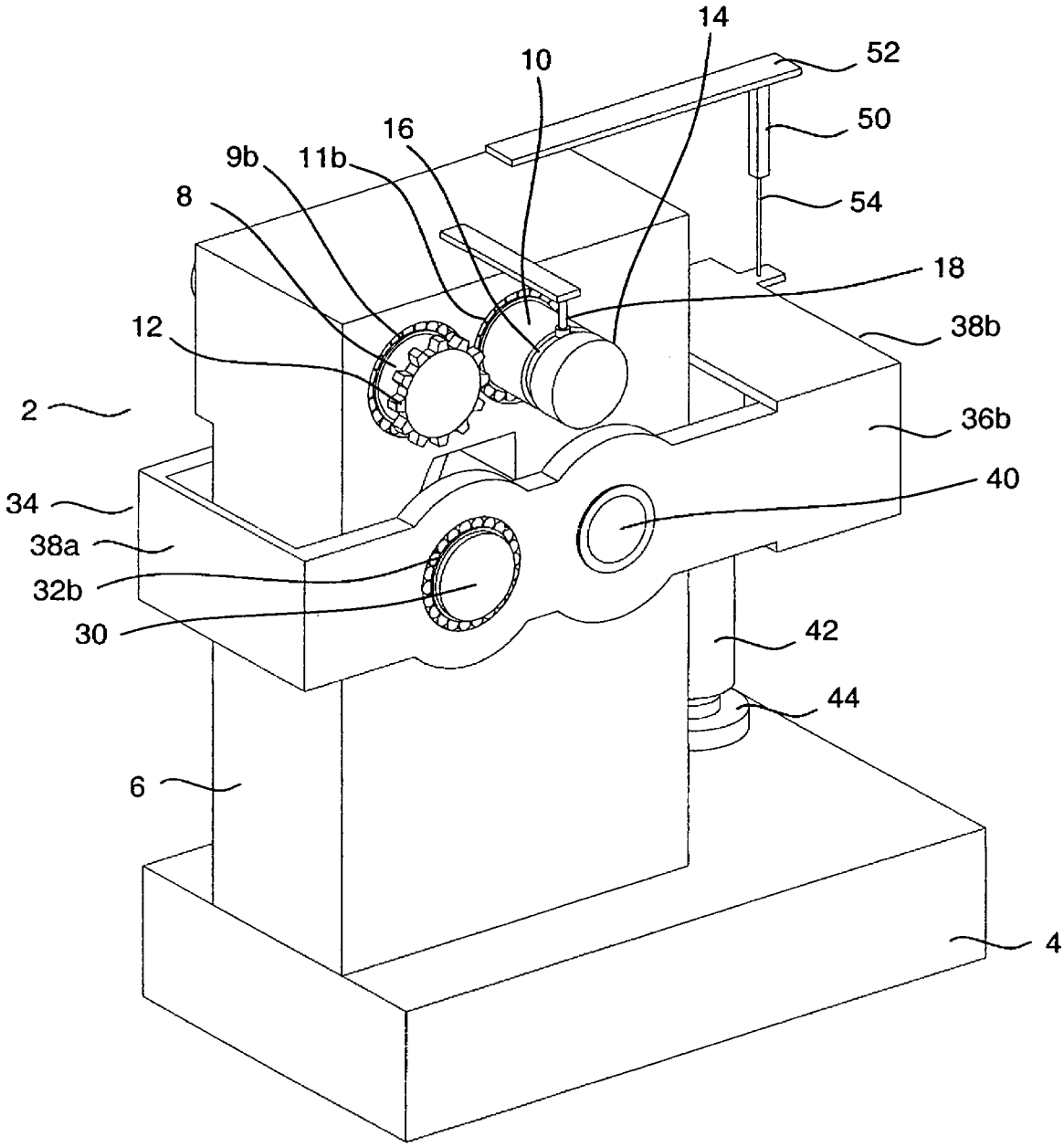
FIG. 2 shows a perspective back view of this embodiment.
Figure 3:
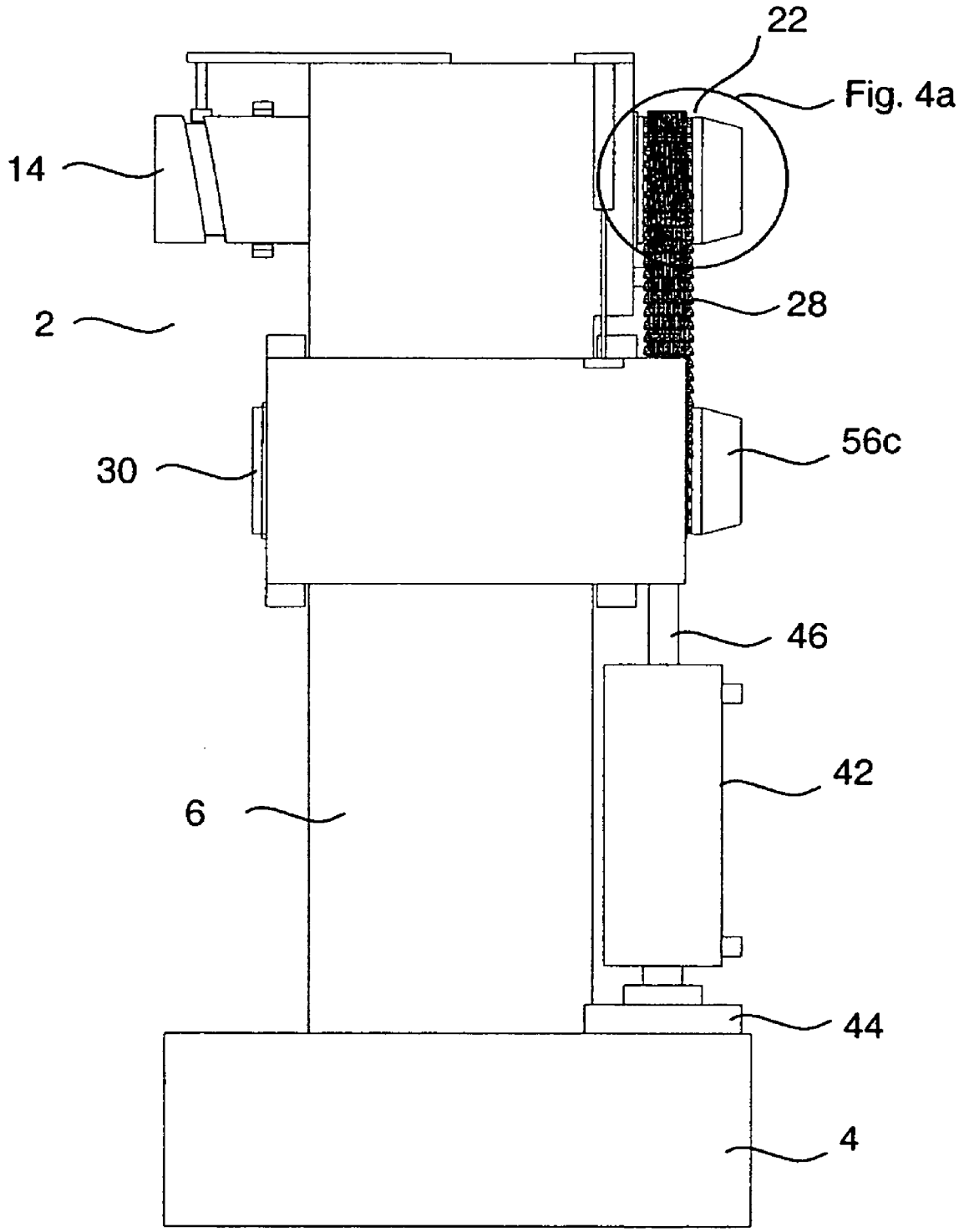
FIG. 3 shows a side view of an apparatus according to the invention.

The apparatus which is shown in the drawings and is denoted therein with reference numeral 2 comprises a base plate 4 which supports a very stiff, schematically shown, frame 6 which is of generally parallepipedum shape. Near the upper end thereof this frame supports in suitable bearings 9*a*, 9*b* and 11*a*, 11*b* respectively the shafts 8, 10 respectively, of which the shaft 8 carries at the rear side of the frame—visible in FIG. 2—a drive gear wheel 12, while the shaft 10 is provided in its outer surface with a guide groove 16 to obtain a periodical axial displacement of the end 14 of this shaft; to this end this groove cooperates with a fixed cam 18 so that rotation of the end 14 of the shaft necessarily results into an axial displacement of the shaft 10. However, this feature is only optional and not strictly necessary.

Figure 4A:
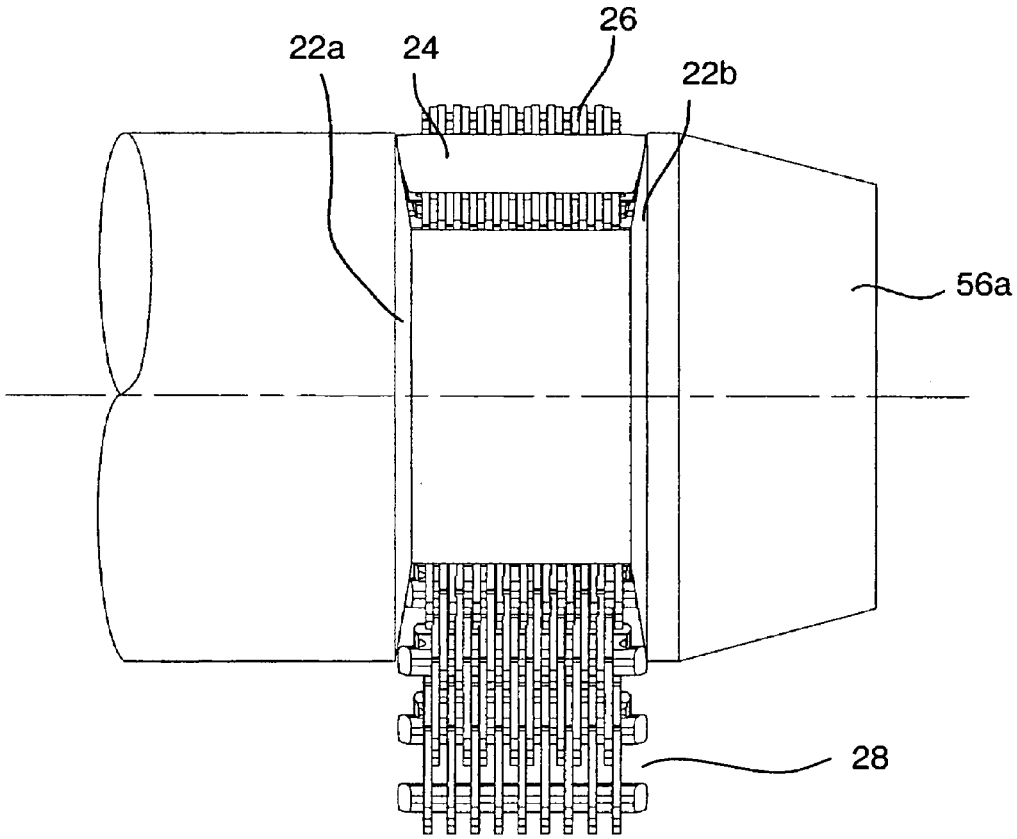
FIG. 4*a* shows in cross-section and schematically a pair of supporting surfaces enclosed by the circle 4*b;*

At their other ends both shafts 8, 10 carry a double conical supporting surface 20, 22, respectively, shown on an enlarged scale in FIG. 4*a*. As this figure shows there is a shallow groove, bounded by two, low, conical sheave surfaces 22*a*, 22*b* on which the ends of the rocker pins (such as the rocker pin 24, shown in cross-section) rest during their movement along these surfaces and this figure also shows schematically the links 26 which are mutually coupled by means of the rocker pins 24, with also a part of a complete transmission chain 28.

Beneath the two shafts 8, 10 with their pairs of supporting surfaces there is a third shaft 30, with a pair of supporting surfaces 31, and this shaft is, by means of suitable bearings 32*a*, 32*b*, supported in a yoke 34, with the long sides 36*a*, 36*b* which run along front and rear side of frame 6 and the short sides 38*a*, 38*b*. By means of a shaft 40 this yoke is supported by the frame 6. The yoke can be tilt over a limited angle around this shaft 40 and is driven by a linear, double acting actuator 42 which rests via a pressure sensor 44 upon the base plate 4 while the piston rod 46 thereof is coupled to the short side 38*b* of the yoke 34, as close as possible to the plane of symmetry through the three pairs of supporting surfaces.

Finally there is a, schematically shown, displacement sensor 50 which is, by means of the arm 52, coupled to the frame and which is by means of the tracer pin 54, coupled to the arm 38*b* of the yoke 34.

To facilitate the mounting of the transmission chain around the double conical supporting surfaces of the three respective shafts at the end of each of these shafts is provided a conical guiding cap, made from a light material and denoted by 56*a*, 56*b* en 56*c*, respectively. This is, of course, not strictly necessary.

Figure 4B:
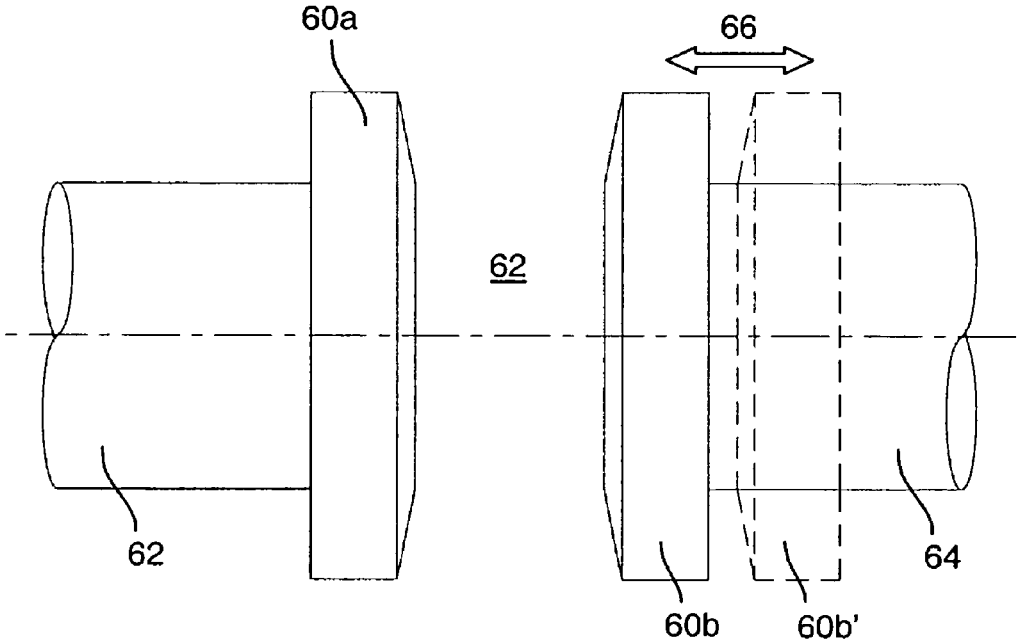

The mounting of a chain to be stretched is made very much easier and thus also quicker when at least one of the pairs of supporting surfaces is adjustable in axial direction and provided in such a way that there is a free space between the respective supporting surfaces to let a shaft pass. This is shown in FIG. 4*b*. The supporting surface 60*a* is carried by a shaft 62 while the supporting surface 60*b*, which is carried by the shaft 64, can be moved in the direction of the arrows 66 and can be brought from the position, as shown with drawn lines, in the position 60*b*, shown with broken lines. In this latter position a chain can pass through the space 62 between the surfaces 60*a*, 60*b*.

During the stretching of the chain this chain can be sprayed with a suitable lubricant by means of a nozzle 58.

After the foregoing description the operation of the apparatus will be clear. By retracting the double acting actuator 42 the movable shaft with the double conical supporting surface moves upwardly and then a chain to be stretched can be positioned around the three respective shafts. Thereafter a controlled supply of a hydraulic pressure medium results in an upward movement of the piston rod 46, so that the chain is biased with a predetermined force. Then the initial length of the chain is determined by means of the sensor 50, 54. Thereafter the piston 46 and with it the end 38*b* of the yoke is moved upwardly with a greater force so that the shaft which is supported by the yoke moves downwardly and the chain is stretched in such a way that the limit of elasticity is surpassed. During this operation the shaft 8 is driven rotatingly by means of the gear wheel 12. Thereafter the resulting permanent elongation is determined by means of the sensor 50, 54.

Although not shown in the drawing it is possible that the shaft 10 is coupled to a device for exerting an adjustable braking torque on this shaft, thus providing an additional and adjustable loading of the chain.

Figure 5A:
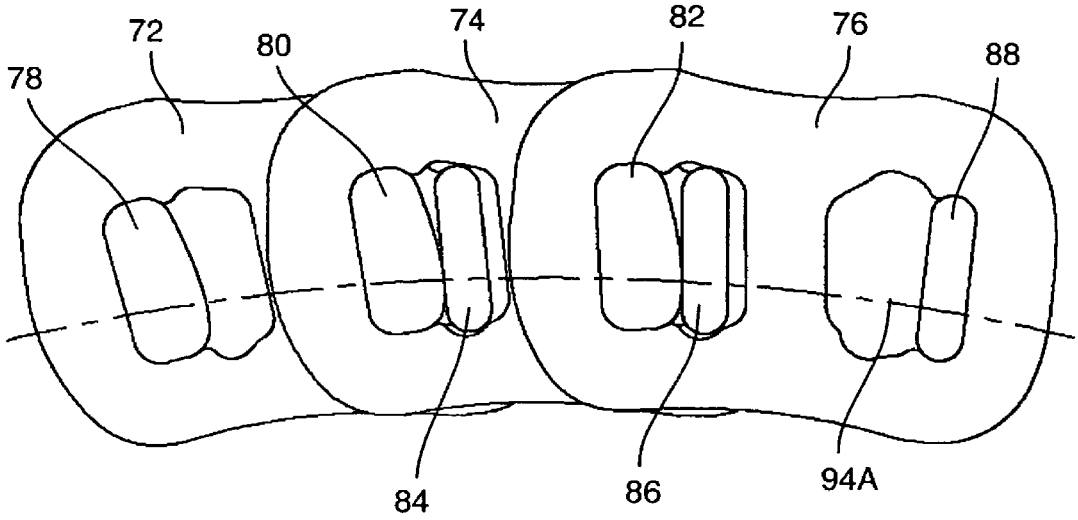
FIG. 5*a* shows in a side view and on an enlarged scale three consecutive links of a transmission chain of the kind known from EP 741 255 and shows the mutual positions of pins and interpieces thereof when such a chain runs over the supporting surfaces with the largest possible running radius.
Figure 6A:
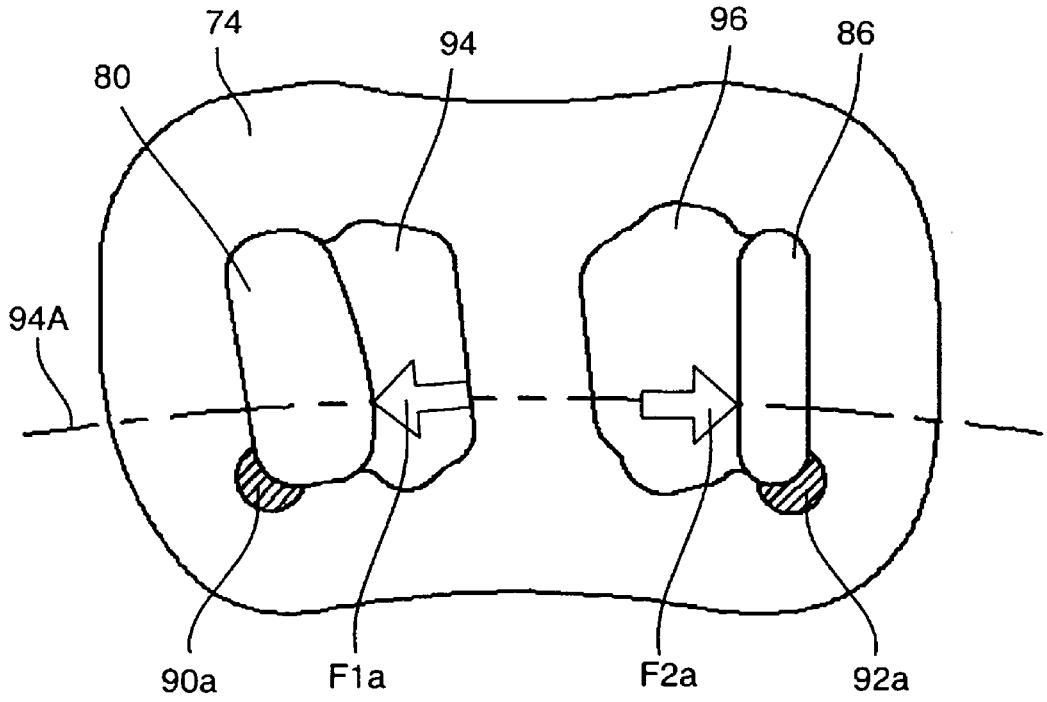
FIGS. 6*a*, 6*b* and 6*c* respectively each show a side view of an individual link with indicated therein the heaviest loaded areas during the running with the abovementioned three running radii while FIG. 6*b* also shows the loading of the side surface of an interpiece.

It will be clear that the actions of mounting the chain, biasing the chain, the measuring of the initial length, the rotatingly driving of the chain and the stretching of the chain can not only be effected with a manual control, but also in an automated process, during which for each chain the relevant parameters, determined during the process, are stored. Driving the gear wheel 12 of the shaft 8 with a higher speed makes it possible to check the correct running of the finished chain FIG. 5*a* shows in a side view three links 72, 74 and 76 respectively intercoupled by the combinations (pairs) of rocker pins 78, 80, 82 on the one hand and interpieces 84, 86, 88 on the other hand. Shown is thus a part of a transmission chain of the kind such as known from EP-741 255 B2 and U.S. Pat. No. 5,728,021 in the state in which it is supported on a supporting surface at the largest possible running radius. 94A. FIG. 6*a* shows the most heavily loaded areas of each individual link of such a chain resulting from the forces F1*a* and F2*a* and exerted via a pin such as the pin 80 and an interpiece such as indicated by 86; these are the hatched areas 90*a*, 92*a* in the lower left- and right hand corners respectively of the openings 94 and 96 respectively.

Figure 5B:
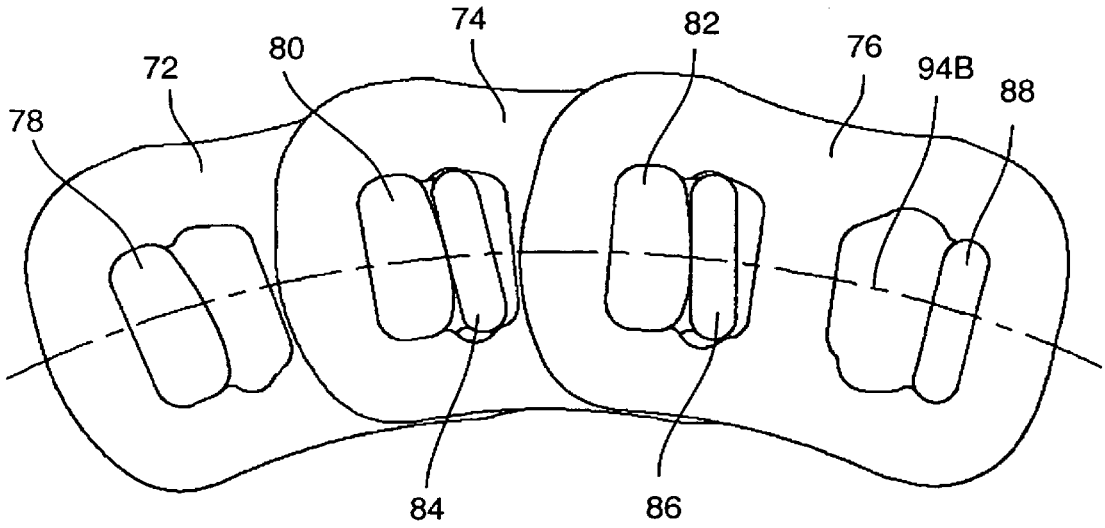
FIG. 5*b* shows in a similar view the state in which the chain describes an intermediate running radius such as defined above.
Figure 6B:
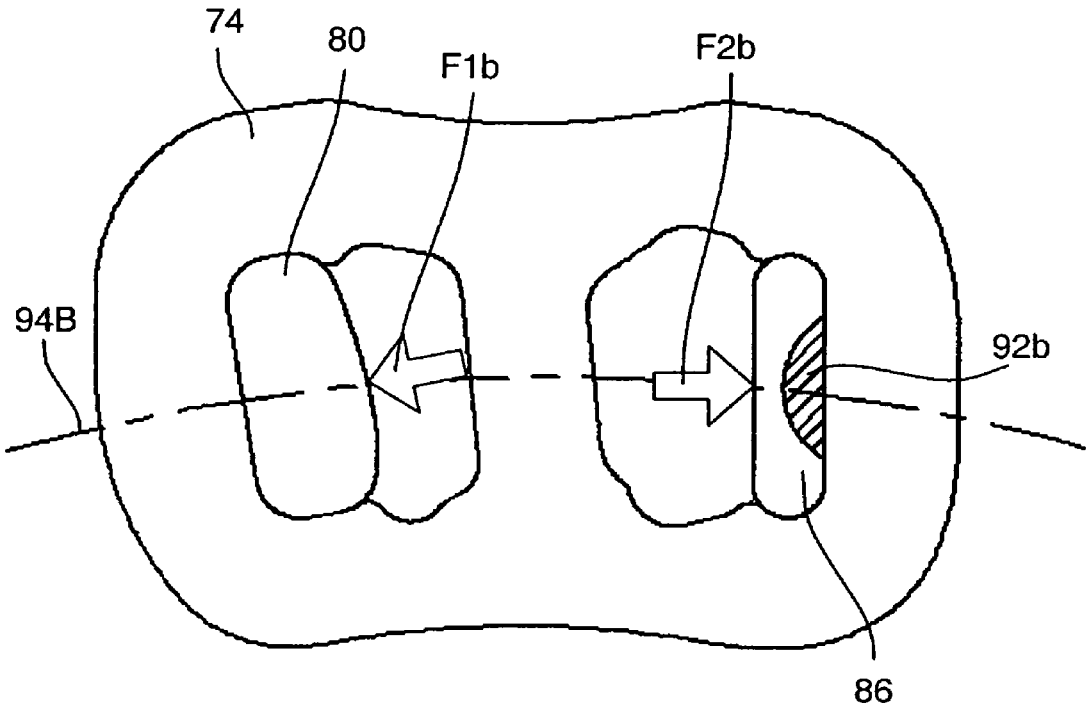

FIGS. 5*b* and 6*b* show in similar views the situation in which the chain describes a curve with a running radius 94B smaller than the largest one but still larger than the smallest possible running radius: in particular FIG. 6*b* shows that in such a situation particularly the central part 92*b* of an interpiece such as the interpiece 86 is loaded, and thus stretched and strenghtened which is very favourable.

Figure 5C:
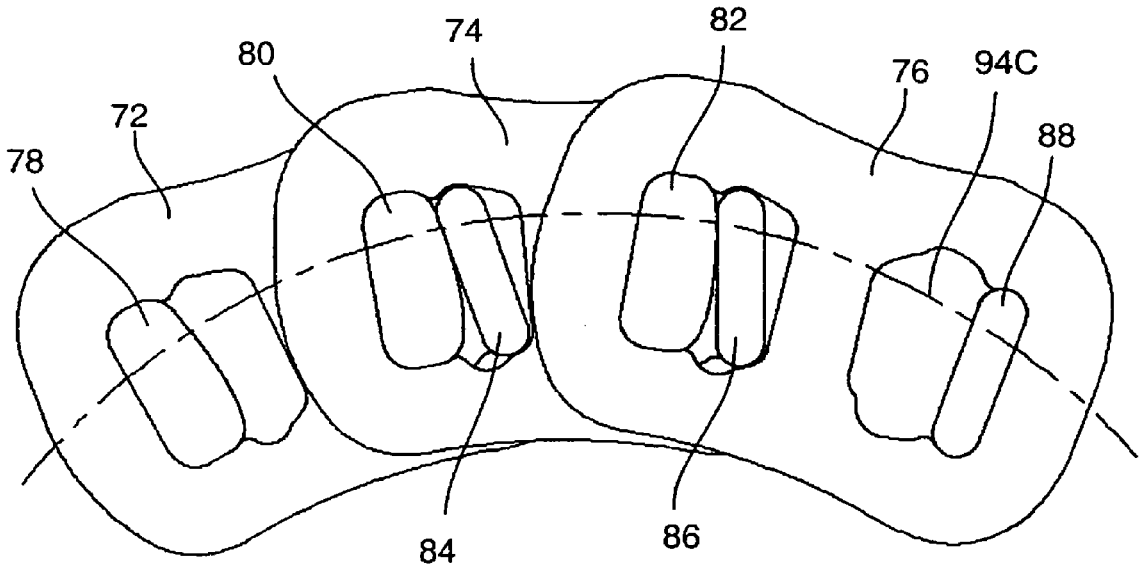
FIG. 5*c* shows a similar view but now for the smallest running radius.
Figure 6C:
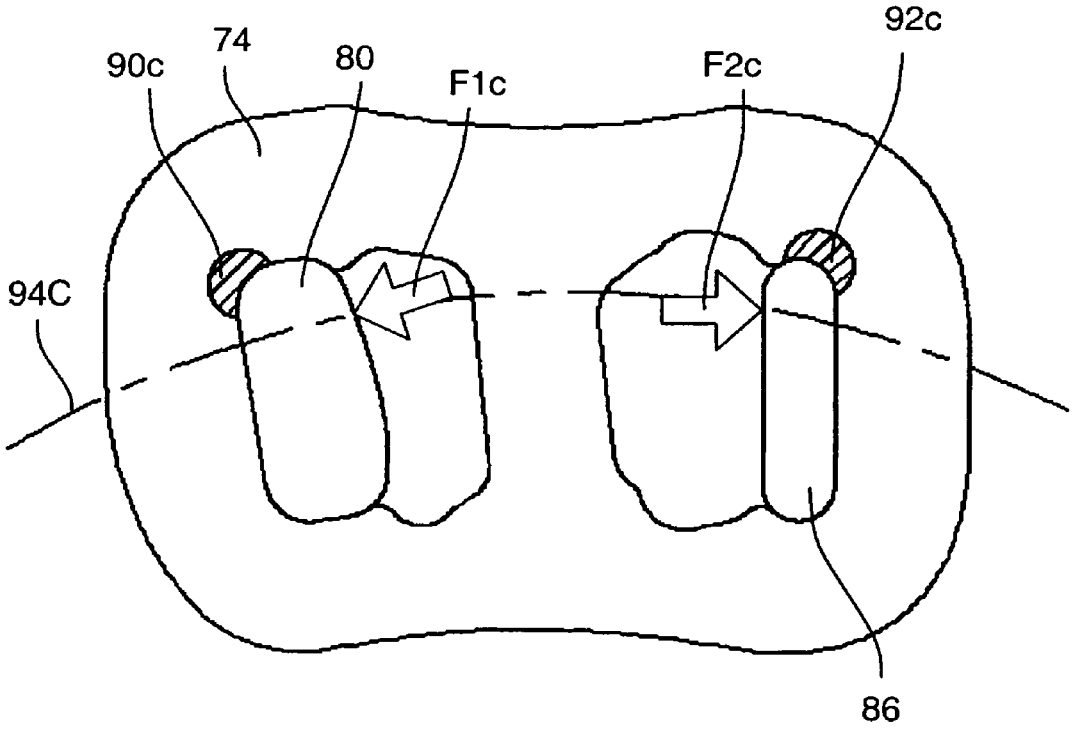

FIGS. 5*c* and 6*c* show in similar views the situation when the chain runs with the smallest possible running radius 94*c*: the loadings resulting from the forces F1*a* and F2*a* are now transferred to the upper left and right hand corners 90*c*, 92*c* respectively as FIG. 6*c*—in which the forces are indicated with F1*c* and F2*c* respectively—shows.

When the chain runs around three supporting surfaces, preferably with mutually different running radius in the way as defined above, it is ensured that all the respective critical areas of the components thereof (as indicated by hatchings in FIGS. 6*a*, 6*b* and 6*c*) are stretched beyond the limit of elasticity thereof, and thus strengthened, in an effective way and in the shortest possible time.

The invention claimed is:

1. An endless transmission chain stretching apparatus which surpasses the limit of elasticity of a chain to be stretched, said chain comprising links intercoupled by rocker pins, said apparatus comprising: a first pair and a second pair of conical supporting surfaces for the ends of the rocker pins, resting thereon, while protruding outside the links of the transmission chain which is arranged there around, said surfaces being carried by rotatingly supported shafts with a controlled mutual distance, and a third pair of conical supporting surfaces carried by a third rotating shaft, cooperating with the first and second pair of surfaces in supporting a chain to be stretched, all three pairs of supporting surfaces having such a running radius and being positioned with respect to each other in such a way that said chain covers an arc over each of said supporting surfaces sufficient to ensure that the links of the chain experience, during their travel over said arc, an ensured and sufficient stretching loading of these areas thereof which undergo a heaviest loading during actual operation of said chain, in which the axes of the first and second shaft lie on respective vertexes of a first side of an imaginary, equilateral triangle while the axis of the third shaft lies on an adjustable distance from these axes on the vertexes of the second and third sides respectively of this triangle.

2. The apparatus according to claim 1 comprising means for accurately measuring a final length of a chain stretched thereby.

3. The apparatus according to claim 1, comprising means for measuring a displacement of at least one of the pair of supporting surfaces.

4. The apparatus according to claim 1, in which three respective rollers have supporting surfaces with mutually different effective diameters with a first value, corresponding with a minimum running diameter encountered in a continuously variable transmission (CVT) in which the said chain is to be used, a second value corresponding with a maximum running diameter to be encountered in said CVT and an intermediate value.

5. The apparatus according to claim 1, in which in of at least one of the pairs of supporting surfaces a space between the supporting surfaces can be free and a mutual distance of the supporting surface can be increased for passing a chain to be treated.

6. The apparatus according to claim 1, in which in at least one pair of supporting surfaces a projected height of the conical supporting surfaces is essentially equal to a height of the rocker pins of a chain to be stretched and to be supported thereby placed therein.

7. The apparatus according to claim 1, in which the first and the second shaft respectively are fixedly supported in a frame or support and the third shaft is supported in a tilting yoke, hingedly supported by this frame and having one end connected to a linear actuator coupled to said frame.

8. The apparatus according to claim 7, in which the actuator acts upon the yoke in a plane which essentially coincides with the plane of symmetry of the pairs of supporting surfaces.

9. The apparatus according to claim 7, comprising a force sensor in the connection between the actuator and the frame and a sensor for measuring a displacement of the yoke.

10. The apparatus according to claim 1, in which a pair of supporting surfaces is coupled with a rotating drive.

11. The apparatus according to claim 1, in which a pair of supporting surfaces is controllably displaceable in an axial direction.

12. The apparatus according to claim 1, in which a pair of supporting surfaces is coupled to an adjustable braking device.

* * * * *